US005246289A

United States Patent [19]

Middleton et al.

[11] Patent Number: 5,246,289

[45] Date of Patent: Sep. 21, 1993

[54] AGITATOR HAVING STREAMLINED BLADES FOR REDUCED CAVITATION

[75] Inventors: John C. Middleton, Cheshire; Michael Cooke, Widnes, both of England

[73] Assignee: Imperial Chemical Industries PLC, London, England

[21] Appl. No.: 649,866

[22] Filed: Feb. 5, 1991

[30] Foreign Application Priority Data

Feb. 5, 1990 [GB] United Kingdom ..... 9002539
Jan. 8, 1991 [GB] United Kingdom ..... 9100305

[51] Int. Cl.[5] ..... B01F 3/04; B01F 5/12; B01F 7/16

[52] U.S. Cl. ..... 366/270; 261/93; 366/262; 366/325; 366/330; 416/197 R; 416/237; 416/243

[58] Field of Search ..... 261/84, 87, 93; 416/197 R, 223 R, 243, 211, 202, 237; 366/101-104, 107, 241, 262-265, 279, 325, 329, 330, 343, 270

[56] References Cited

U.S. PATENT DOCUMENTS

| | | | |
|---|---|---|---|
| 481,668 | 8/1892 | Howard | 416/211 |
| 636,400 | 11/1899 | Friedman | 416/211 |
| 1,011,259 | 12/1911 | Smith et al. | 416/243 X |
| 1,372,834 | 3/1921 | Schmelzer | 416/197 |
| 1,579,355 | 4/1926 | Greenawalt . | |
| 3,051,072 | 8/1962 | Bohanon | 416/197 R |
| 4,305,673 | 12/1981 | Herbst . | |
| 4,382,191 | 5/1983 | Potter | 416/202 A |
| 4,519,715 | 5/1985 | Golobic et al. | 366/343 |
| 4,548,765 | 10/1985 | Hultholm et al. | 261/93 |
| 4,779,990 | 10/1988 | Hjort et al. | 366/279 X |
| 4,799,862 | 1/1989 | Davidson et al. | 416/243 X |
| 5,037,209 | 8/1991 | Wyss | 366/246 |
| 5,078,505 | 1/1992 | Nyman et al. | 366/263 X |

FOREIGN PATENT DOCUMENTS

| | | | |
|---|---|---|---|
| 451893 | 10/1948 | Canada | 366/102 |
| 0224459 | 6/1987 | European Pat. Off. . | |
| 0234768 | 9/1987 | European Pat. Off. . | |
| 0347618 | 12/1989 | European Pat. Off. . | |
| 1191339 | 4/1965 | Fed. Rep. of Germany . | |
| 2207144 | 8/1973 | Fed. Rep. of Germany . | |
| 2503838 | 8/1976 | Fed. Rep. of Germany . | |
| 2735388 | 7/1978 | Fed. Rep. of Germany . | |
| 12611 | of 1884 | United Kingdom | 416/243 |

*Primary Examiner*—Harvey C. Hornsby
*Assistant Examiner*—Charles Cooley
*Attorney, Agent, or Firm*—Cushman, Darby & Cushman

[57] ABSTRACT

An agitator assembly for use in effecting dispersion of a fluid such as a gas in a liquid comprises a rotor having a rotatably driven shaft 18 mounting a series of scoop-shaped blades 20 which are oriented with the mouths 21 of the scoops presented in the direction of rotation of the shaft, each blade being mounted at an angle of attack such that one end of the blade leads the other in the direction of rotation. To eliminate gas cavity formation, each blade is of generally streamlined configuration in section and the ends 30 thereof are generally transverse to the axis of rotation of the rotor.

15 Claims, 4 Drawing Sheets

AGITATOR HAVING STREAMLINED BLADES FOR REDUCED CAVITATION

BACKGROUND OF THE INVENTION

1. Field of the Invention

This invention relates to agitators for the dispersion of a fluid in a liquid.

2. Description of the Related Art

The invention is particularly concerned with an agitator of the kind disclosed in our prior EP-A-234768 which discloses an agitator assembly for use in dispersing fluids in liquids, the assembly including a rotor provided with scoop shaped blades oriented with the mouths of the scoops facing the direction of rotation of the rotor and arranged so as to impart radial and/or axial flow to the liquid, the blades being so shaped as to minimize fluid cavity formation at the trailing side thereof (a fluid cavity being an accumulation of the lighter phase at the trailing side of the blades where low pressure regions such as vortices can develop).

In some circumstances, there is a requirement for the blades to be set at an angle of attack such that one end of the blade leads the other blade end in the direction of motion of the blade. EP-A-234768 refers to the possibility of setting the blades at an attack angle provided that the attack angle is not so great as to give rise to the formation of substantial vortices.

SUMMARY OF THE INVENTION

According to the present invention there is provided an agitator assembly for use in the dispersion of a fluid in a liquid, comprising a rotor mounted for rotation about an axis, means for rotating the rotor in a predetermined direction, and a plurality of blades mounted on the shaft, each blade being of concave configuration with a mouth through which liquid can enter the interior of the blade and each blade being oriented such that the mouth of the blade is at the leading side of the blade and one end of the blade leads the other in said direction of rotation whereby, in use, liquid enters each blade through the mouth thereof and is discharged through one of the ends of the blade, at least one end of each blade being generally parallel to the direction of motion of the blade.

Although the invention has application to agitators in which the blades are oriented to impart predominantly radial flow to the discharged liquid, preferably each blade is oriented so as to impart predominantly axial flow to liquid discharged thereby and both ends of the blade are generally transverse to the axis of rotation.

In practice the rotor is mounted in a reservoir containing the liquid such that the blades are wholly immersed and means is provided for sparging a fluid into liquid in the reservoir, the fluid sparging means and the rotor being so constructed and arranged that, in use, the rotor blades (submerged in the liquid) and/or the liquid flow they generate disperse the sparged fluid.

Each blade employed in the present invention will usually have a configuration such that rearwardly of the leading edges defining the mouth of the blade the blade has no external concave surface and it lies about a "blade plane" which contains both the principal axis of the blade and the trailing extremity of the blade. Thus the blade plane preferably extends in directions which are generally axial and tangential with the principal axis of the blade skewed so that one end of the blade leads the other blade end. However, in embodiments in which predominantly axial discharge flow is imparted to the liquid, the blade plane may nevertheless extend in a direction also having some radial component so as to impart a radial component to the generally axial discharge flow.

Usually all the blades are identically oriented.

In conventional disc turbine agitators, e.g., with conventional axially aligned paddle blades for the dispersion of sparged gases as small bubbles in liquids, we have found that vortices (which are a potential source of gas-logging, cavitation, and reduced gas dispersion and mixing) are generated where fluid flow is not streamlined along the blade surface, but becomes "separated", for example at projecting edges (e.g., the axial edges of conventional axially-aligned paddle blades), where a trailing external surface is concave, or where there is no acute trailing edge, e.g., with circular, elliptical, square or oblong cross-section blades. The blades of the present invention avoid these disadvantageous features.

Each blade may have a symmetrical cross-section, and may be of generally part-circular, parabolic or part-elliptical section. In the vicinity of its trailing extremity, the blade may be of continuous outwardly convex curvature or it may be sphenoidal (i.e., wedge shaped). A preferred blade shape is a symmetrical aerofoil-like cross-section.

The concave configuration of the blade results in its being hollow and the mouth is preferably in the form of a slot defined by leading edges of the blade; however, the mouth may alternatively be in the form of one or more holes.

One end of each blade is at least partially open so that the blade provides a scooping action which disperses and mixes by pumping the scooped liquid through that end. Often both ends are open.

To enhance the action of the turbine in which a tangential intake into the blade is converted into an axial output, it is preferred that the principal axis of the blade is skewed with respect to the axis of rotation at an angle within the range 15° to 75°, more preferably 30° to 60°, relative to a plane normal to the axis of rotation.

Although usually the interior of the trailing extremity of each blade is generally rectilinear and parallel with the principal axis of blade, in some cases it may be concavely curved along the line of that extremity, e.g., concavely arcuate, so that the direction of flow through the blade is changed smoothly from tangential intake to predominantly axial discharge.

During rotation, each blade plane describes an imaginary cylinder or truncated cone to which the blade plane usually forms a tangent. Often the blade will be mounted in the rotor assembly so that the imaginary figure is a cylinder, i.e., the blade does not appear to be angled in or out with respect to the axis of rotation.

In use, e.g. in the mixing of gas-sparged tank contents, no substantial vortex low-pressure zone forms behind each blade of the rotating turbine, and with the gas flow rates frequently encountered in industry, the gas flows over the outer surface of the blades, and in all cases is dispersed in a zone generally axially of the blades where the blades are oriented to produce a predominantly axial discharge flow.

The present apparatus has further advantages if used to mix multiphase reagent systems; it can promote good inter-phase mass transfer and thus may often improve reaction yields, and reaction selectivity at higher throughput.

Typically the blades will be made of conventional metals or plastics used for turbine agitator paddles.

The blades of the present turbine rotor may be arranged circumferentially and/or radially within the same rotational tier or in any number of parallel rotational tiers. It is preferred that the blades are arranged regularly within any one tier or a plurality of tiers so that rotational balance is maximized.

Preferably they are also (as apt) so arranged along the shaft and with respect to each blade in any other tier or plurality of tiers in accordance with routine engineering practice that torsional balance is maximized.

For example, they may be arranged with equal numbers of blades rotatable in each tier in the plurality, and with corresponding blades in different tiers axially in register or with all the tiers aligned regularly rotationally skewed with respect to one another.

The rotor may have two or more blades. The mixing efficiency of the turbine will generally increase with the number of blades in any one tier until such point that the blades are so close with respect to their transverse dimension that in use the action of any one blade interferes with the action of the following blade.

Similarly the useful number of tiers of blades is limited by any mutual interference between the tiers due to proximity, which disadvantageously reduces dispersion and mixing efficiency and can cause vortex formation and cavitation.

The addition of further tiers of blades increasingly remote from a single axial sparging source may also not increase the efficiency of dispersion. However, it may still assist mixing of the liquid and/or liquid-fluid dispersion in the reservoir.

Subject to the foregoing, suitable blade numbers include 2 to 24 blades in a tier, typically 4 to 12, and typically up to 5 tiers of blades, usually 1 or 2.

Typically, dimensions of the rotor are determined by the size of the reservoir, and usually the diameter will be one third to a half the corresponding reservoir transverse dimension.

The fluid sparging means may have a single aperture, or multiple apertures such as a row, grid, rose or ring. Although the sparging of liquids, in particular those less dense than the reservoir liquids, is not excluded, the sparged fluid will often be a gas.

The rotor and fluid sparging means may be placed in any orientation and mutual position which ensures that the fluid is delivered either to the volume swept by the rotor blades or to any directly adjacent zone on which any liquid flow generated by the rotor blades impinges (in both cases "the dispersion zone").

The rotor may be mounted in any orientation, although it will often be convenient to mount it upright with the sparging means mounted on the reservoir above or below it, e.g., spaced axially from it. In this way, the fluid may be delivered to the dispersion zone through the liquid essentially under gravity, either from below for a gas or liquid less dense than the reservoir liquid or from above for a denser liquid. The sparging means may then suitably be a hole, rose or ring coaxial with the rotor.

Blades fulfilling the foregoing criteria for a blade of the present invention will each generally have a symmetrical cross-section; however, asymmetrical blade configurations are not excluded.

It will be apparent that an axial hole, rose or ring sparging means of smaller diameter than the overall rotor diameter which does not overlap the swept volume within the reservoir will not deliver fluid to the dispersion zone without a deflector. In such a case the blades may conveniently be mounted extending from the periphery of a rotor disc, the disc acting as a deflector.

The fluid may of course be delivered to a zone axially extending outside the volume swept by the blades into which liquid is pumped by the blades.

Additionally, the rotor may be mounted crosswise with the sparging means mounted on the reservoir above or below the rotor and spaced axially from it. Again, this arrangement conveniently allows delivery essentially under gravity.

The sparging means may then suitably be an axially aligned row, a transverse straight or arcuate row or a planar or curved grid depending on the rotor structure.

In another aspect the sparging means may be mounted on the rotor, for example as an aperture or apertures in front of each blade or spaced axially from the or a blade plane.

Orientations of the rotor appropriate to or compatible with the disposition of the sparging means and blades will be self-evident to the skilled man. In particular, where the rotor is mounted coaxially with and above or below the sparging means, the blades may be so arranged in a self-evident manner that the liquid output from the rotor is co- or counter-current to the sparged fluid.

Although useful in all applications where dispersion of two fluid phases is required, the present assembly is particularly useful for gas-liquid mass transfer processes. It is also particularly useful for low-shear thorough mixing, e.g., of sensitive substrates such as living cell fermentation suspensions or polymer latices or dispersions subject to ready degradation or coagulation.

BRIEF DESCRIPTION OF THE DRAWINGS

The invention will now be described by way of example only with reference to the accompanying drawings in which.

DETAILED DESCRIPTION OF THE PRESENTLY PREFERRED EXEMPLARY EMBODIMENTS

Figure 1:
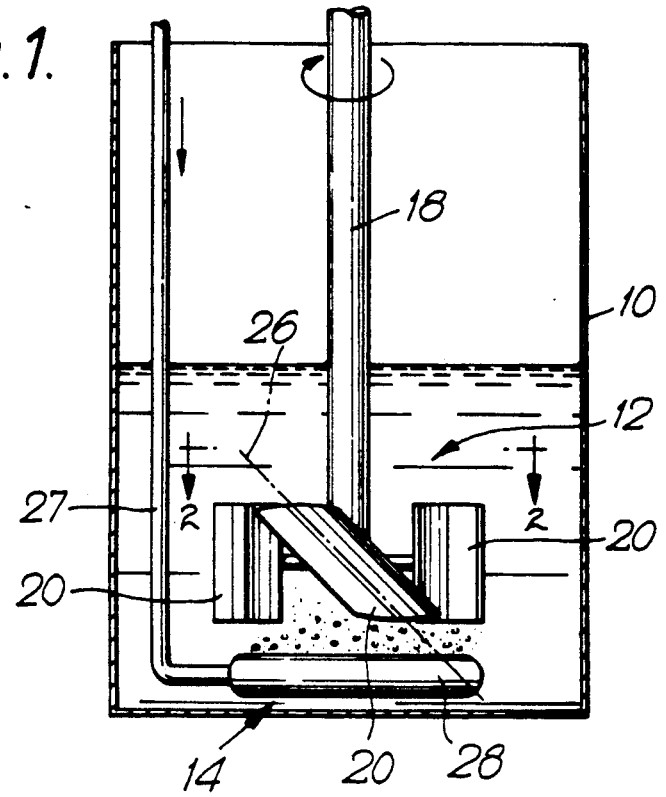
FIG. 1 is a diagrammatic view showing a mixing vessel fitted with an agitator in accordance with the invention.
Figure 2:
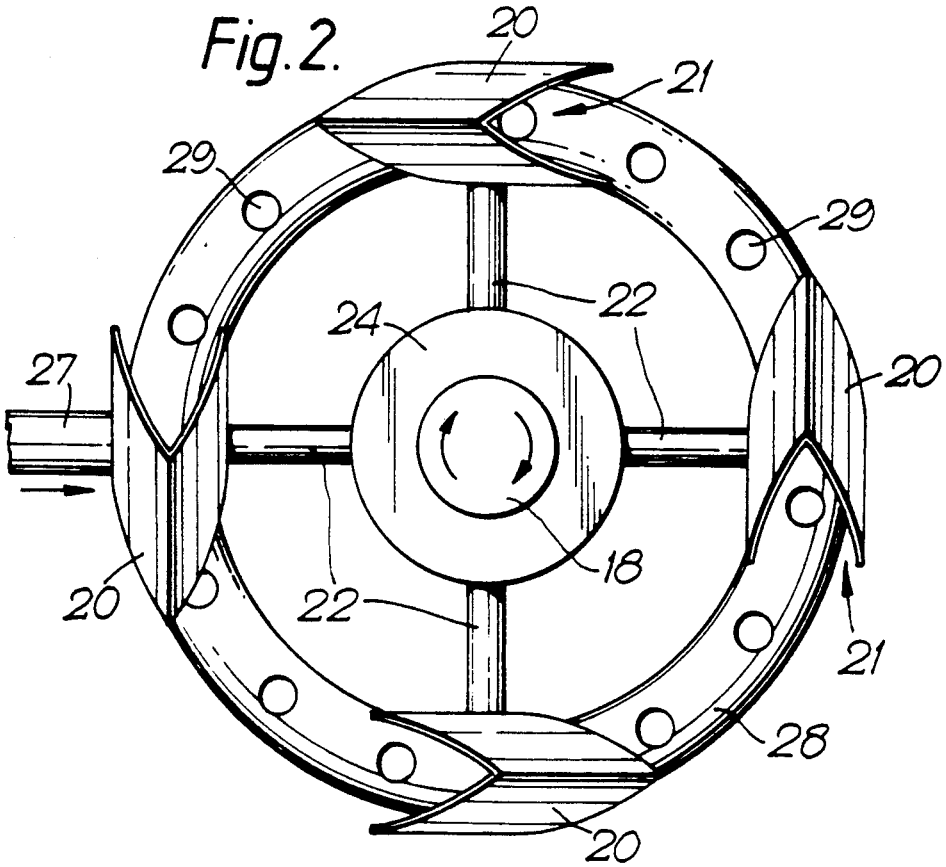
FIG. 2 is a plan view taken in the direction 2—2 in FIG. 1.

Referring to FIGS. 1 an 2, apparatus for dispersing a gas in a liquid comprises a generally cylindrical vessel 10 containing the liquid, an agitator assembly 12 and a gas sparging arrangement 14. The agitator assembly comprises a shaft 18 mounted by unshown means for rotation about its vertically disposed axis and, as seen in FIG. 2, the shaft 18 mounts a number of scoop-shaped blades 20 via radially extending arms 22 projecting from a hub 24, the blades being fully immersed in the liquid. The shaft 18 is driven by an unshown motor and drive transmission in a clockwise direction as seen in FIG. 2.

In order to impart axial flow to the liquid, each blade 20 is set at an attack angle such that its principal axis 26 (see FIG. 1) extends obliquely with respect to the longitudinal axis of the shaft 18 and in a plane generally tangential to rotation of the blade, and the open mouth 21 of each scoop-shaped blade 20 is presented at the leading side of the blade. As described hereinafter, the precise configuration of each blade 20 may vary but, in general, the blades are oriented so that they sweep through the liquid as the shaft rotates and scoop liquid via their open mouths and discharge the liquid in a predominantly axial direction relative to the shaft axis, at least one of the ends of each blade being at least partially open to permit such discharge. In the embodiment of FIGS. 1 and 2, the blades serve to pump the liquid axially in a downward direction, i.e., towards the base of the vessel 10, and at least the lower end of each blade is open to allow discharge in the downward direction. Typically both ends of each blade are open.

The gas sparging arrangement 14 may take various forms and, as illustrated, comprises a horizontally mounted ring 28 formed with circumferentially spaced outlets 29 at its upper side, gas being supplied to the ring 28 in any suitable manner, e.g., by a feed pipe 27. The blades 20 are located so that they overlie the ring 28, although this is not essential. In use, gas is bubbled into the liquid and is entrained with the liquid flow induced by the blades and thereby dispersed into the liquid.

In accordance with the teaching in our prior EP-A-234768, each blade 20 in a plane perpendicular to its principal axis 26 has a generally aerofoil-like section so as to reduce or eliminate the formation of a gas cavity at its trailing surface. Although such shaping of the blade section will considerably reduce undesirable cavity formation at the trailing surface of the blade, contrary to the teaching in EP-A-234678 in accordance with the present invention each blade can be set at a substantial attack angle and this is made possible by designing the blade such that its ends do not promote the formation of vortices and hence gas containing cavities.

Figure 3:
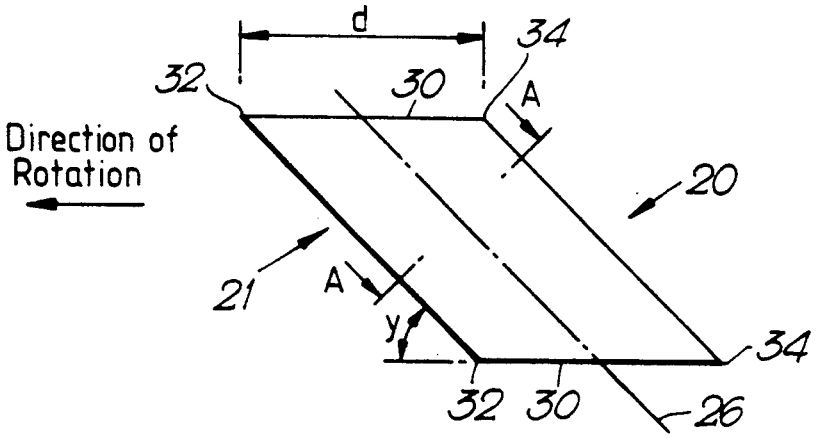
FIG. 3 is a diagrammatic side elevation of a blade in accordance with the invention.

Referring to FIG. 3, in one embodiment of the invention each blade is set at an angle of attack or rake angle y of about 45° relative to a plane normal to the rotational axis of the shaft 18 and to allow the use of such an angle of attack without producing formation of any substantial formation of vortices, the ends 30 of the blade are made substantially transverse to the axis of rotation of the shaft so that the blade is of parallelogram configuration as viewed from the side instead of being of rectangular configuration as disclosed in EP-A-234678. In this way, the leading and trailing extremities 32, 34 of each blade end follow substantially the same surface of revolution as the blades sweep through the liquid.

Figure 4:
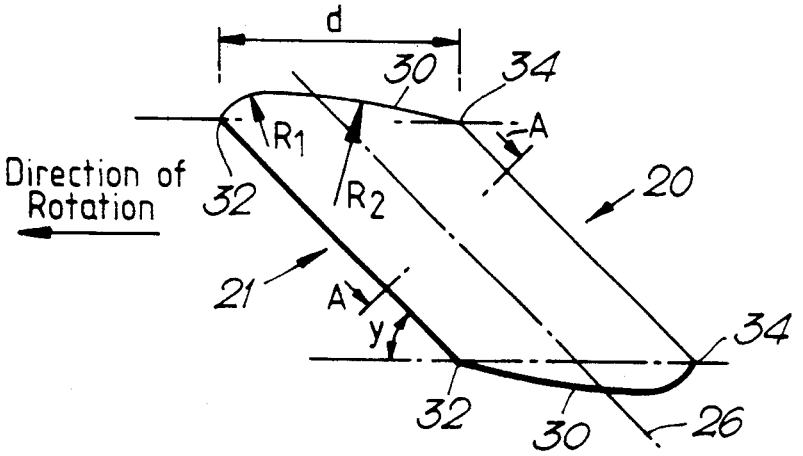
FIGS. 4 and 5 are views similar to FIG. 3 showing modifications.

In the embodiment of FIG. 3, the blade ends 30 are rectilinear. Preferably however, in order to obtain improved performance, the blade ends 30 are made curvilinear to afford at least a measure of streamlining. FIG. 4 illustrates a near ideal case in which the streamlining is achieved by forming the blade with two separate radii $R_1$ and $R_2$ where $R_1$ has a tighter radius than $R_2$ and the two curves blend without any discontinuity. Thus, in FIG. 4, the leading and trailing extremities 32, 34 of each blade end lie in a common plane normal to the axis of rotation and are joined by curvilinear edges which afford streamlining to the blade ends.

Figure 5:
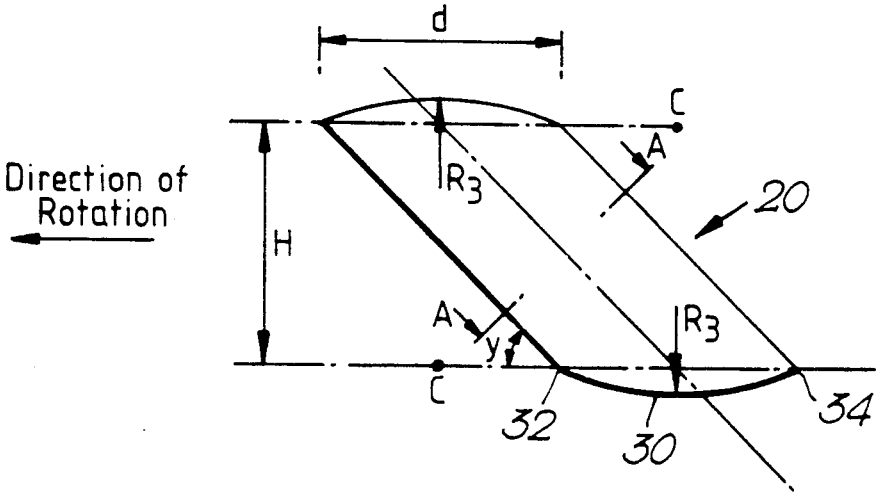

FIG. 5 illustrates a simpler design from a production standpoint in which a close approximation to streamlining is obtained using curvilinear edges defined by a single radius $R_3$. Again the leading and trailing extremities 32, 34 of each blade end lie in a common plane normal to the axis of rotation. Where, as illustrated, y is of the order of 45° and the dimension H is substantially the same as the dimension d measured from a line joining the leading extremities 32 to the trailing extremity 34, a suitable value for $R_3$ can be derived by dropping a perpendicular from midway between the extremities 32 and 34 at one end to find the point of intersection C with the line joining the extremities at the other end and then using point C as the center curvature.

Typically for each of the embodiments described above, the perpendicular distance d is between D/4 and D/6 where D is the outside diameter of the annulus swept by the blade during rotation of the shaft. Usually the angle y will be within the range 15° to 75°, more preferably 30° to 60°.

Figure 6:
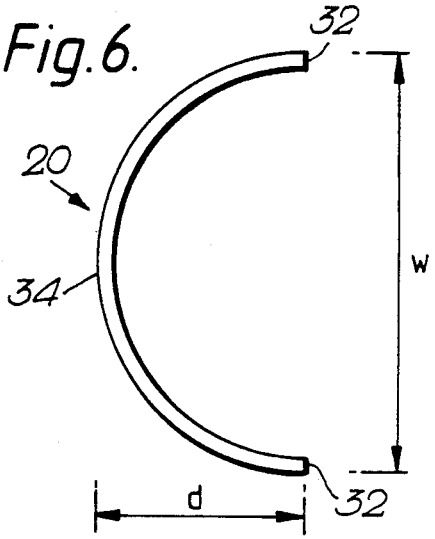
FIGS. 6 to 10 are sectional views in the direction A—A in FIGS. 3 to 5 showing different sectional profiles of the blade.

An important feature of the agitator of the invention is the scoop shaped configuration of the blades since this imparts a significant pumping action to the liquid rather than merely creating turbulence and together with appropriate orientation of the blades, discharge flow in the desired direction can be achieved very effectively. Provided that due consideration is given to the need to achieve sufficient streamlining to produce significant reduction in fluid cavity formation over the trailing surface of the blade, the particular sectional shape of the blade as seen in the direction A—A in the embodiments described above may vary. Thus, the section on A—A may be part-circular as shown in FIG. 6, V-shaped (FIG. 7), generally parabolic or partly elliptical (FIG. 8) or of aerofoil-like shape (FIG. 9). The aerofoil shape of FIG. 9 includes converging lips 40 at the leading side of the section; similar lips may be provided on the sectional profiles shown in FIGS. 6 to 8. It will be noted that some embodiments on the trailing side of the blade are formed with a well-defined trailing edge or spine, namely the embodiments of FIGS. 7 and 9; whilst such an edge is useful in ensuring elimination of any gas cavity at the trailing extremity of the blade, it is not essential and as shown in the embodiments of FIGS. 6 and 8, the trailing surface of the blade may have a smooth contour without any discontinuity forming an edge or spine.

Figure 7:
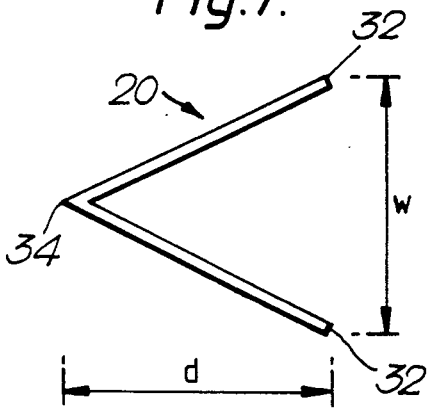
Figure 8:
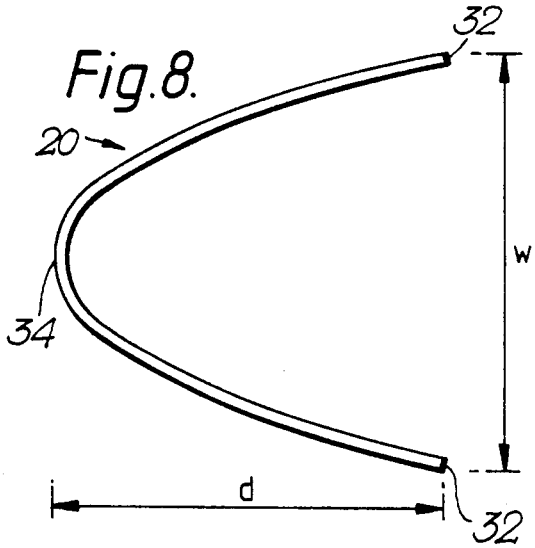
Figure 9:
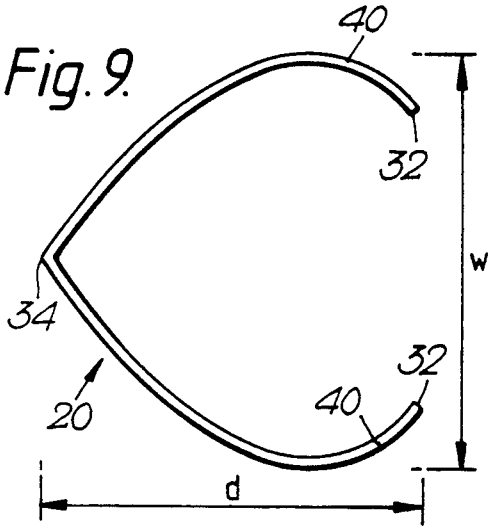

In FIGS. 6 to 9, the dimensions d and w and hence the aspect ratio d/w may vary. In the case of FIG. 6, d and w are typically equal to D/8 and D/4, respectively, giving an aspect ratio of about 0.5. In the case of FIGS. 7 to 9, d and w are both typically D/4 giving an aspect ratio of unity. In general, the power number and the quality of the streamlining will be dependent on the aspect ratio. Thus, lowering the aspect ratio of the blades will tend to increase the power number of the agitator and lead to poorer streamlining which, in turn, will tend to decrease the ratio of gassed to ungassed power. Similarly, increasing the aspect ratio will decrease the power number of the agitator and lead to improved streamlining which, in turn, will increase the ratio of gassed to ungassed power. Thus, by appropriate selection of the aspect ratio, the characteristics of the agitator may be changed in accordance with requirements.

Figure 10:
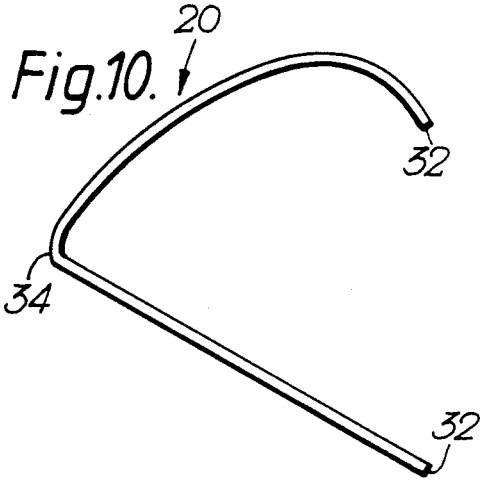

In the case of shapes such as those of FIGS. 8 and 9, it is the radially outer external surfaces of the blade which are the more important from a hydrodynalic standpoint, since the power transmitted is proportional to the fifth power of the swept diameter. Consequently, while such designs are preferred in terms of streamlining, the fact that the radially inner external surfaces are less important hydrodynamically means that these surfaces may be of a simpler, less streamlined configuration, for example as shown in FIG. 10.

Figure 11:
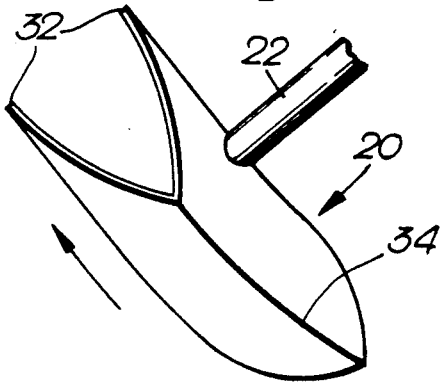
FIG. 11 is a fragmentary view showing a modified form of blade.

Ideally the blade should be shaped in such a way that its trailing extremity (whether well-defined as in FIGS. 7 and 9 or an imaginary line as in FIGS. 6 and 8) is curved so that, as the blade rotates about the shaft axis, it describes a cylindrical surface of rotation concentric with the axis of rotation. Such a blade configuration is shown in FIG. 11 where a spined blade is illustrated to show the curvature clearly. Such a blade configuration has the advantage that it can eliminate the formation of a gas cavity adjacent the trailing extremity and on the radially inner external surface of the blade. However, as mentioned above, it is not usually necessary in practice to employ such a blade configuration in view of the lesser importance of the radially inner external surface from the hydrodynamic standpoint.

Although as shown in FIG. 2, the blades are mounted on radial arms in some applications they may be mounted on a disc or equivalent structure. It will be appreciated that while the agitator in FIGS. 1 and 2 is arranged to effect pumping downwardly and hence in counter-current relation to the gas introduced by the sparging arrangement, it may be readily adapted to pump in an axial upwards direction, for example so that the liquid is pumped in co-current relation with the gas, by inverting the agitator. Usually both ends of each blade will be open; however, in practice liquid will be discharged through only one of the ends and the other end may therefore be closed off. As shown in FIG. 1, the agitator is mounted with its axis extending generally vertically but we do not exclude the possibility of the agitator being mounted in some other orientation, e.g., with its axis disposed generally horizontally and with the blades arranged to effect pumping in the axial direction with respect to the axis of rotation of the agitator.

Figure 12:
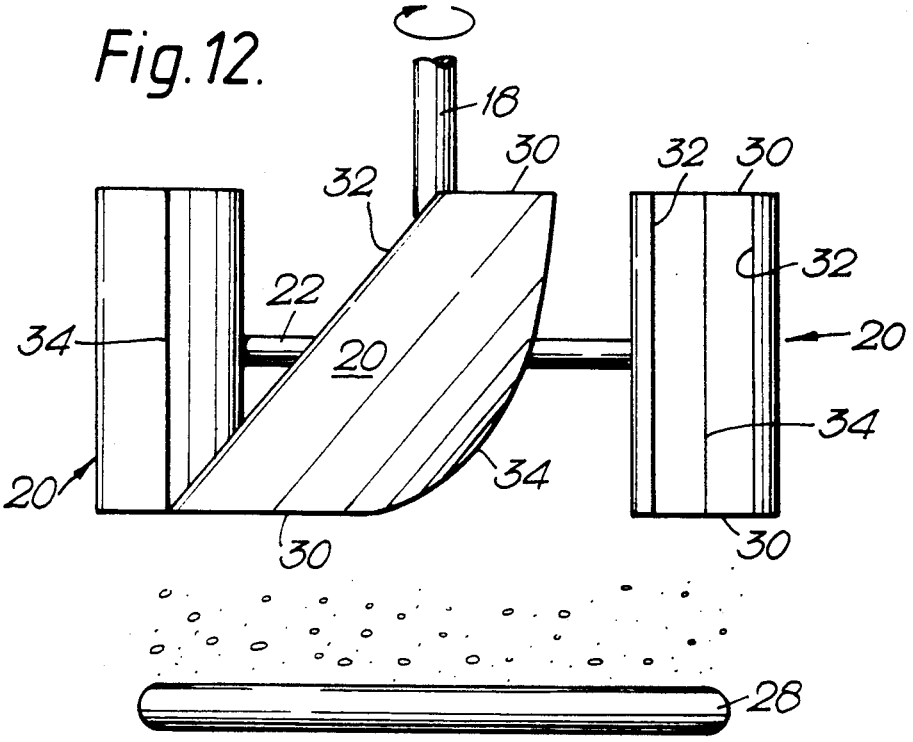
FIG. 12 is a view similar to that of FIG. 1 but showing blades having a curved trailing extremity.

In the embodiment of FIG. 12 which is designed to pump in an axially upwards direction, the trailing extremity 34 of each blade 20 is not rectilinear as in the embodiments of FIGS. 1 to 10; instead it is curved at least in the region adjacent the lower end of the blade (which end may be open or closed according to requirements) so that the liquid entering the scoop-shaped interior of each blade in a generally tangential direction through the mouth of the blade is forced to follow a path which smoothly re-directs the liquid for discharge in an axial direction through the upper open end of the blade.

Figure 13:
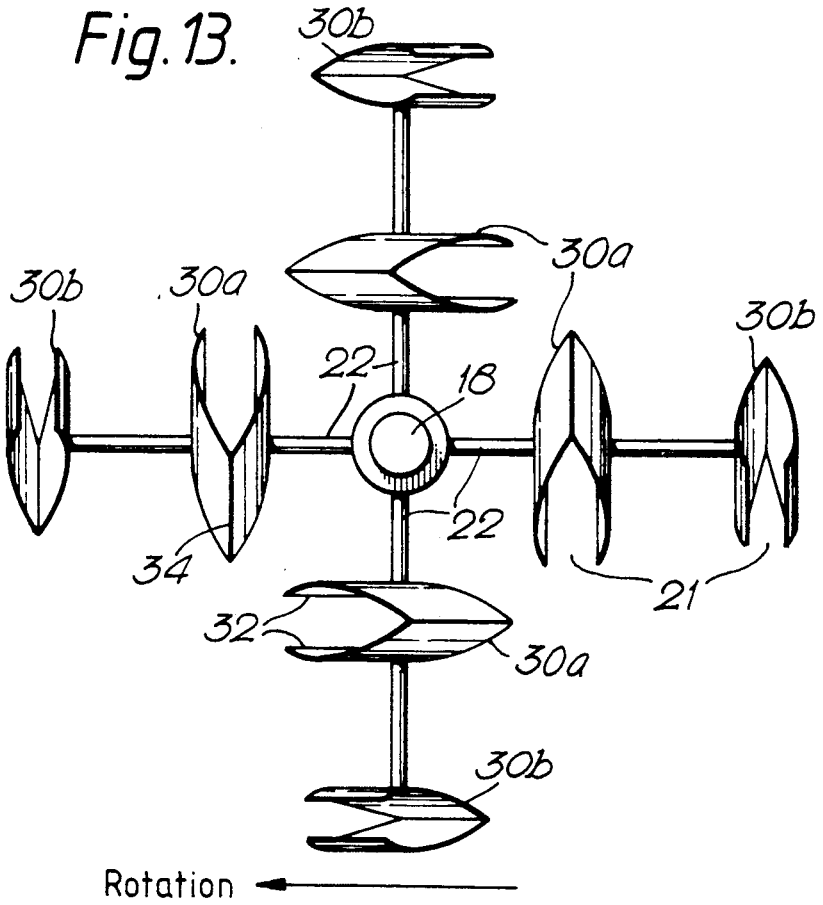
FIG. 13 is a plan view similar to FIG. 2 showing a rotor having two sets of blades arranged so that one set pumps downwardly and the other upwardly.

In some applications, it may be advantageous for the blades to be organized into at least two sets, with the blades in at least one set pumping liquid axially in the opposite direction to the other set(s). FIG. 13 illustrates such an arrangement, in which the shaft 18 via arms 22 mounts a first set of blades 30*a* oriented so as to pump liquid axially in one direction (into the paper as drawn) and a second set 30*b* oriented to pump liquid in the opposite direction (outwardly of the paper as drawn). The particular shape and dimensions of each blade in each set may be in accordance with any one of the embodiments described above. Because of the different centripetal forces acting on the two sets of blades, the outer set 30*b* may be of smaller dimensions. The two sets need not be mounted on common mounting arms 22 as shown in FIG. 13; for instance, the oppositely pumping sets may be mounted on the shaft with one set spaced axially from the other set.

We claim:

1. An agitator assembly for use in the dispersion of a fluid in a liquid, said agitator assembly comprising:

a rotor mounted for rotation about an axis of rotation, means for rotating the rotor in a predetermined direction about said axis of rotation, said rotating means being operatively connected to said rotor, and a plurality of blades mounted on the rotor, each blade being of scoop-shaped configuration with a mouth through which said liquid can enter a space bounded by the blade, said space extending to the mouth, where one end of the blade leads another end in said predetermined direction of rotation and each blade is oriented with respect to said rotor such that the mouth of the blade is at the leading end of the blade, wherein said agitator assembly is adapted to be operated so that liquid enters each blade through the mouth thereof and is discharged through one of the ends of the blade, at least one end of each blade lies on an imaginary surface which is convexly curvilinear, said surface being transverse to said axis of rotation so as to impart a streamlined profile to said at least one end of each blade, and each blade is oriented relative to said rotor so as to impart flow to liquid discharged thereby in a direction which is predominantly parallel to said axis of rotation.

2. An agitator assembly as claimed in claim 1 wherein:

both ends of each blade lie on imaginary surfaces which are convexly curvilinear, said surfaces being transverse to said axis so as to impart a streamlined profile to said ends of said blade.

3. An agitator assembly for use in the dispersion of a fluid in a liquid, said agitator assembly comprising:

a vessel;

a rotor mounted within the vessel for rotation about an axis of rotation, means for rotating the rotor in a predetermined direction about said axis of rotation, said rotating means being operatively connected to said rotor, a plurality of blades mounted on the rotor, each blade being of scoop-shaped configuration with edges of the blade defining a mouth and each blade being oriented with respect to said rotor such that the mouth of the blade is at a leading side of the blade and one end of the blade leads another end in said predetermined direction of rotation, and means for sparging said fluid into the vessel beneath said blades, wherein flow is imparted to liquid discharged from the blades in a direction substantially parallel to said axis of rotation, and the ends of each blade each lie on an imaginary surface which is convexly curvilinear in a direction transverse to said axis of rotation so as to impart a streamlined profile to said ends of each blade.

4. An agitator assembly as claimed in claim 3 in which a cross-sectional shape of each blade in a plane perpendicular to a trailing extremity of the blade is of continuous curvature.

5. An agitator assembly as claimed in claim 4 in which a cross-sectional shape of each blade in said plane perpendicular to said trailing extremity is generally parabolic or part-elliptical.

6. An agitator assembly as claimed in claim 3 in which a cross-sectional shape of each blade in a plane perpendicular to a trailing extremity of the blade is substantially V-shaped.

7. An agitator assembly as claimed in claim 3 in which a cross-sectional shape of each blade in a plane perpendicular to a trailing extremity of the blade comprises two curvilinear sections meeting in a spine, said spine forming the trailing extremity of the blade.

8. An agitator as claimed in claim 3 in which there are at least two sets of blades mounted on the rotor, the blades in at least one set being arranged to produce a liquid discharge flowing in an opposite direction to a liquid discharge flow produced by a different set of blades.

9. An agitator assembly as claimed in claim 2 or 3 in which a trailing extremity of each blade is substantially rectilinear.

10. An agitator assembly as claimed in claim 2 or 3 wherein during rotation of the rotor, a trailing extremity of each blade is of curvilinear configuration and describes an imaginary cylindrical surface concentric with the axis of rotation.

11. An agitator assembly as claimed in claim 2 or 3 in which a trailing extremity of each blade is curvilinear in a plane generally tangential to the predetermined direction of rotation such that liquid entering the blade in a generally tangential direction is deflected into an axial flow by an interior surface of the curvilinear trailing extremity of the blade.

12. An agitator assembly for use in the dispersion of a fluid in a liquid, said agitator assembly comprising:

a vessel, a rotor mounted within the vessel for rotation about an axis of rotation, means for rotating the rotor in a predetermined direction about said axis of rotation, a plurality of blades mounted on the rotor so that the blades follow a circumferential path of motion as the rotor rotates, and means for sparging said fluid into the vessel proximate to the rotor blades, wherein each blade is of scoop-shaped configuration with side walls which diverge from a trailing extremity of the blade and terminate in radially spaced leading edge portions which extend predominantly circumferentially relative to said axis of rotation and define therebetween a mouth through which liquid can enter a space bounded by said side walls, said space extending to said mouth, each blade is oriented with one end thereof leading another end in said predetermined direction of rotation, wherein liquid enters each blade through the mouth thereof and is discharged through one of the ends of the blade, at least one end of each blade generally lying in a plane transverse to said axis of rotation, and each blade is oriented relative to said rotor so as to impart flow to liquid discharged thereby in a direction which is predominantly parallel to said axis of rotation.

13. An agitator assembly as claimed in claim 12 in which the ends of each blade lie on imaginary surfaces which are convexly curvilinear, said imaginary surfaces being transverse to said axis of rotation so as to impart a streamlined profile to said ends of each blade.

14. An agitator assembly as claimed in claim 12 in which the ends of each blade lie on imaginary surfaces having streamlined profiles.

15. An agitator assembly as claimed in claim 12 in which the ends of each blade lie on imaginary surfaces which are planar.

* * * * *